US008102636B2

(12) United States Patent
Johnson et al.

(10) Patent No.: US 8,102,636 B2
(45) Date of Patent: Jan. 24, 2012

(54) MAGNETIC FIELD GENERATION DEVICE

(75) Inventors: Mark Thomas Johnson, Eindhoven (NL); Jacob Marinus Jan Den Toonder, Eindhoven (NL); Murray Fulton Gillies, Eindhoven (NL); Marc Wilhelmus Gijsbert Ponjee, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 222 days.

(21) Appl. No.: 12/377,609

(22) PCT Filed: Aug. 10, 2007

(86) PCT No.: PCT/IB2007/053183

§ 371 (c)(1),
(2), (4) Date: Feb. 16, 2009

(87) PCT Pub. No.: WO2008/020380

PCT Pub. Date: Feb. 21, 2008

(65) Prior Publication Data

US 2010/0165534 A1 Jul. 1, 2010

(30) Foreign Application Priority Data

Aug. 15, 2006 (EP) ..... 06118916

(51) Int. Cl.
*H01H 47/00* (2006.01)

(52) U.S. Cl. ..... 361/139

(58) Field of Classification Search ..... 361/139
See application file for complete search history.

(56) References Cited

U.S. PATENT DOCUMENTS

| | | | | |
|---|---|---|---|---|
| 4,743,830 | A * | 5/1988 | Lakey | 320/104 |
| 4,846,715 | A | 7/1989 | Gasiunas et al. | |
| 6,229,506 | B1 * | 5/2001 | Dawson et al. | 345/82 |
| 6,619,311 | B2 | 9/2003 | O'Connor et al. | |
| 6,710,587 | B1 * | 3/2004 | Reynoso et al. | 324/117 R |
| 6,716,642 | B1 | 4/2004 | Wu et al. | |
| 2002/0150683 | A1 | 10/2002 | Troian et al. | |
| 2004/0070557 | A1 | 4/2004 | Asano et al. | |
| 2004/0077105 | A1 | 4/2004 | Wu et al. | |
| 2006/0020371 | A1 | 1/2006 | Ham et al. | |

FOREIGN PATENT DOCUMENTS

| | | | |
|---|---|---|---|
| WO | 0047983 | A1 | 8/2000 |
| WO | 2006035938 | A1 | 4/2006 |

OTHER PUBLICATIONS

V. V. Khatavkar, et al; Modeling micro-actuator motion in a microchannel for local mixing, Materials Technology, Dutch Polymer Institute, Eindhoven University of Technology, p. 1.

R. M. A. Dawson, et al; 24.1 Pursuit of Active Matrix Organic Light Emitting Diode Displays, SID Symposium Digest of Technical Papers—Jun. 2001—vol. 32, Issue 1, pp. 372-375.

A. Yumoto, et al; Pixel-Driving Methods for Large-Sized Poly-Si AM-OLED Displays, Asia Display IDW '01, pp. 1305.

* cited by examiner

*Primary Examiner* — Ronald W Leja

(57) ABSTRACT

The present invention relates to a magnetic field generation device comprising a magnetic field generating element (101) and a limiter (103) for limiting a magnitude of a current through the magnetic field generating element (101).

14 Claims, 4 Drawing Sheets

MAGNETIC FIELD GENERATION DEVICE

FIELD OF THE INVENTION

The present invention is concerned with devices for the generation of magnetic fields, especially the generation of magnetic fields in biological micro-fluidic devices.

BACKGROUND OF THE INVENTION

Micro-fluidics relates to a multidisciplinary field comprising physics, chemistry, engineering and biotechnology that studies the behavior of fluids at volumes thousands of times smaller than a common droplet. Micro-fluidic components form the basis of so-called "lab-on-a-chip" devices or biochip networks that can process micro-liter and nano-liter volumes of fluid and conduct highly sensitive analytical measurements. The fabrication techniques used to construct micro-fluidic devices are relatively inexpensive and allow mass production of highly elaborate, multiplexed devices. In a manner similar to that for microelectronics, micro-fluidic technologies enable the fabrication of highly integrated devices for performing several different functions on the same substrate chip.

Micro-fluidic chips are becoming a key foundation to many of today's fast-growing biotechnologies, such as rapid DNA separation and sizing, cell manipulation, cell sorting and molecule detection. Micro-fluidic chip-based technologies offer many advantages over their traditional macro-sized counterparts. Micro-fluidics is a critical component in, amongst others, gene chip and protein chip development efforts.

In all micro-fluidic devices, there is a basic need for controlling the fluid flow, that is, fluids must be transported, mixed, separated and directed through a micro-channel system consisting of channels with a typical width of about 0.1 mm. A challenge in micro-fluidic actuation is to design a compact and reliable micro-fluidic system for regulating or manipulating the flow of complex fluids of variable composition, e.g. saliva and full blood, in micro-channels. Various actuation mechanisms have been developed and are at present used, such as, for example, pressure-driven schemes, micro-fabricated mechanical valves and pumps, inkjet-type pumps, electro-kinetically controlled flows and surface-acoustic waves.

U.S. Pat. No. 4,846,715 discloses a voice coil motor assembly for a voice coil motor printwheel setting apparatus comprising a plate having the voice coil motor coils mounted thereon. The plate is adapted for attachment to a printed circuit board by pins electrically connected to the voice coils. Picker links having coil magnets connected thereto are stacked in sequence and the final assembly is completed by enshrouding the voice magnets with the voice coils mounted on the plate. For driving an assembly of voice coil motor's there is a voice coil matrix switching device. Switching is performed by power transistors.

WO 2006/035938 discloses an oscillation magnetic field generation device including an electromagnet and an electromagnet drive circuit for driving the electromagnet. Excitation current is supplied from a DC power source to the electromagnet. The electromagnet drive circuit includes: a switching element for controlling on/off of the excitation current; an electromagnetic energy emission circuit and pulse generator means.

WO 00/47983 discloses an electrochemical biosensor system based on enzyme-linked immuno-magnetic sandwich assay wherein an interdigitated array of electrodes is equipped with a magnet to attract magnetic beads. The magnetic field generation device 150 may be activated/deactivated by an on/off switch 152, or the like. The switch may be under the control of a system controller 100 or the like.

US 2006/020371 A1 discloses a microfluid system (300) containing fluid in proximity to complementary metal oxide semiconductor (CMOS) fabricated field-generating components (200). At least one controller controls the field-generating components to generate an electric or magnetic field sufficiently strong as to interact with at least one sample suspended in the fluid. FIG. 15 illustrates the contents of the microcoil switching unit 460-4 shown in FIG. 14. Each microcoil switching unit includes a microcoil 212 connected to a current direction (polarity) switch 460-5 (S1) and a coil enable switch 460-6 (S2).

US 2004/077105 discloses an array of microcoils. The microcoils are fabricated from conductive traces. FIGS. 10-11 show the principle of addressing individual micro-electromagnetic units by using electric switches. In FIG. 10, each unit 41 is connected to the common electrical current source 43 and the common ground 45 (i.e. current sink) through two electric switches 37 and 239 in series. The switch 37 is controlled by electric signals applied to the rows 30 of the electroconductive lines. The switch 39 is controlled by electric signals applied to the columns of the electroconductive lines.

US 2004/0070557 discloses an active matrix display device. To compensate for the threshold voltage which tends to cause luminance irregularities easily, a threshold compensation pixel circuit is used.

SUMMARY OF THE INVENTION

It is the object of the present invention to provide an efficient concept for generating magnetic fields in e.g. micro-fluidic devices.

This object is achieved by the features of the independent claims.

The present invention is based on the finding that magnetic fields in micro-fluidic devices can be generated both efficiently and locally upon a basis of limiting a current through a magnetic field generating element, e.g. a magnetic field generating micro-element.

The invention provides a magnetic field generation device comprising a magnetic field generating element, e.g. a wire, and a limiter for limiting a magnitude of a current through the magnetic field generating element.

The limiter, e.g. an electronic circuit for controlling the current, may comprise an electronic switch. e.g. a transistor switch, for switching on or off a current through the magnetic field generating element. Furthermore, the limiter may determine a voltage on the gate of the transistor in order to control the current through the magnetic field generating element.

According to an aspect, the current may be generated by an external current source or by an internal current source. The current source may be formed by a transistor circuit or may comprise only one transistor.

In addition, the magnetic field generation device may comprise a memory element, e.g. a capacitor, for programming a change of a magnetic field after the device is no longer being addressed, e.g. when a control signal is no longer receivable. The magnetic field generation device may comprise a magnetic field sensor which is e.g. a local sensor assigned to the magnetic field generating element. The magnetic field sensor senses the magnetic field or its magnitude exploiting e.g. the Hall-effect or the (giant)magnetoresistive effect.

According to an aspect, the magnetic field generation device may comprise a controller for controlling the limiter.

The controller may further control the limiter in response to a measurement signal provided by the magnetic field sensor. For example, the controller may cause the limiter to limit the magnitude of the current so as to achieve the predetermined magnetic field profile.

The magnetic field generation device may further comprise a current source with a transistor for generating the current through the magnetic field generating element. In order to compensate for threshold voltage variations of individual transistors, the magnetic field generation device further comprises a threshold voltage compensation circuit for compensating threshold variations across the transistor. The threshold voltage compensation circuit may comprise a plurality of transistors and capacitors arranged to compensate the threshold variations. In order to further compensate the mobility variations of the individual transistor, the magnetic field generation device further comprises a mobility compensation circuit for compensating mobility of the individual transistor. The mobility compensation circuit may comprise a plurality of transistors and capacitors arranged to compensate the mobility variations.

Preferably, the magnetic field generation device is realised in large area electronics technology which also is employed for manufacturing an active matrix, e.g. TFTs or LCDs such as low temperature poly silicon (LTPS), amorphous Si, diode, MIM (metal-insulator-metal) etc. Furthermore, the device may be realized in the CMOS-based technology. Preferably, the driving of such an array is realized using e.g. active matrix or CMOS-based driving principles.

According to an aspect, the magnetic field generation device may comprise a plurality of magnetic field generating elements being e.g. arranged to form a matrix and a plurality of current sources, wherein each current source is locally assigned to a magnetic field generating element.

According to an aspect, the micro-actuator may be a ciliary actuator element having a shape and an orientation, wherein the field generating element may cause a change in their shape and/or orientation.

According to an embodiment, the actuator elements may be polymer actuator elements and may for example comprise polymer MEMS. Polymer materials are, generally, tough instead of brittle, relatively cheap, elastic up to large strains (up to 10%) and offer perspective of being processable on large surface areas with simple processes. Therefore, they are particularly suitable for being used to form actuator elements according to the present invention.

The actuator elements may further comprise one of a uniform continuous magnetic layer, a patterned continuous magnetic layer or magnetic particles. Furthermore, a plurality of ciliary actuator elements may be arranged in a first and second row, the first row of actuator elements being positioned at a first position of the inner side of the wall and the second row of actuator elements being positioned at a second position of the inner side of the wall, the first position and the second position being substantially opposite to each other. In addition, a magnetic field generating device may be locally assigned to each actuator element or to a subset of the actuator elements.

The invention further provides a micro-fluidic device comprising a plurality of magnetic field generation devices according to the invention which are e.g. arranged to form a matrix. Furthermore, the micro-fluidic device may comprise a plurality of micro-actuators for generating a flow, mixing, separation or re-directing a fluid in response to a magnetic field. The micro-actuators being actuated by a respective magnetic field generation device locally assigned to the micro-actuator.

The micro-actuator may comprise a (e.g. rollable) magnetic polymer being actuated by the magnetic field generated by the magnetic field generation device.

The micro-fluidic device may be used in one or more of the following applications:

bio-sensors used for molecular diagnostics;

rapid and sensitive detection of proteins and nucleic acids in complex biological mixtures such as e.g. blood or saliva;

high throughput screening devices for chemistry, pharmaceuticals or molecular biology;

testing devices e.g. for DNA or proteins e.g. in criminology, for on-site testing (in a hospital), for diagnostics in centralized laboratories or in scientific research;

tools for DNA or protein diagnostics for cardiology, infectious disease and oncology, food, and environmental diagnostics;

tools for combinatorial chemistry; or analysis devices.

BRIEF DESCRIPTION OF THE DRAWINGS

Further embodiments of the present invention are described with reference to the following figures, in which.

DETAILED DESCRIPTION OF THE INVENTION

Before the invention is described in detail, it is to be understood that this invention is not limited to the particular component parts of the devices described or process steps of the methods described as such devices and methods may vary. It is also to be understood that the terminology used herein is for purposes of describing particular embodiments only, and is not intended to be limiting. It must be noted that, as used in the specification and the appended claims, the singular forms "a," "an" and "the" include singular and/or plural referents unless the context clearly dictates otherwise. Thus, for example, reference to "a fluid" may includes mixtures, reference to "a heat device" includes two or more such devices, reference to "a micro channel" includes more than one such channels, and the like.

To provide a comprehensive disclosure without unduly lengthening the specification, the applicant hereby incorporates by reference each of the patents and patent applications referenced above.

Figure 1:
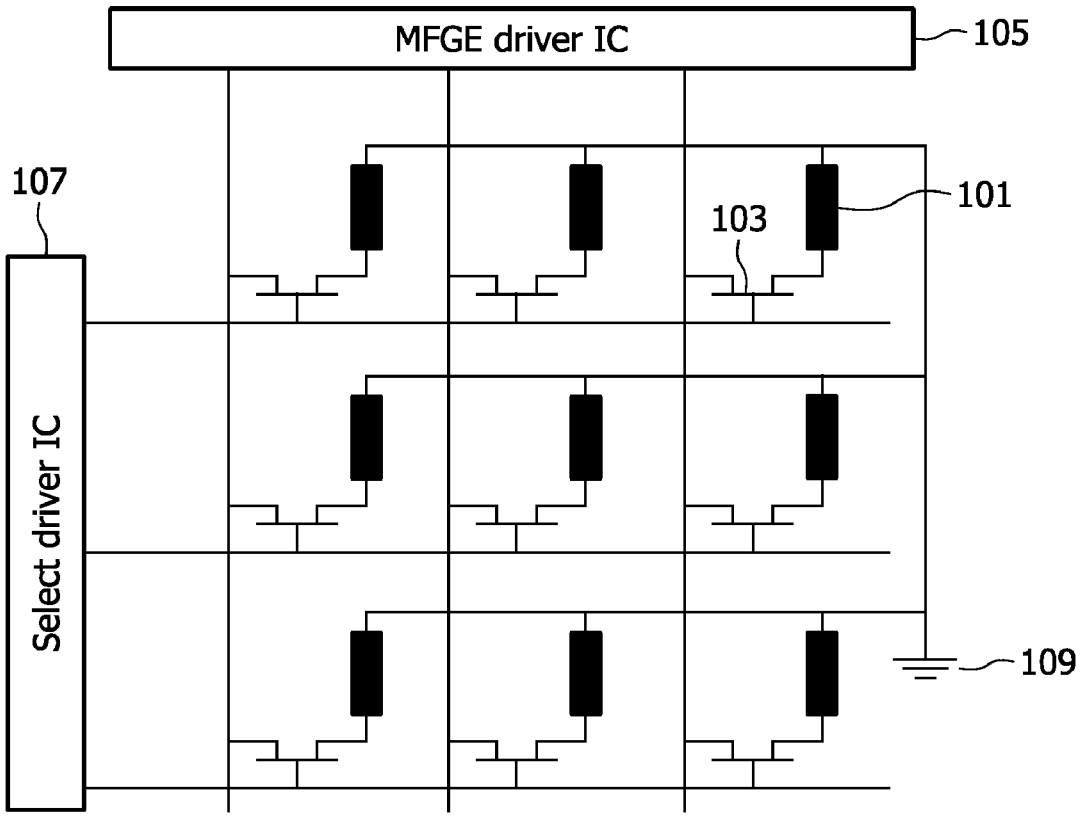
FIG. 1 shows a magnetic field generation device according to an aspect.

FIG. 1 shows a magnetic field generation device comprising a plurality of magnetic field generating elements 101 (magnetic field elements) being arranged to form a matrix. Furthermore, a plurality of limiters (e.g. electronic switches) 103 is provided, each limiter being associated with a corresponding magnetic field generating element 101. The limiter 101 may be formed by transistors by way of example.

Furthermore, an external driver for the active matrix magnetic field generating element (MFGE) system is provided. The device further comprises a magnetic field element driver 105, e.g. a driver IC, and a select driver 107 arranged as shown in FIG. 1. Furthermore, a common electrode 109 is connected to all magnetic field elements 101.

In the embodiment shown in FIG. 1, a magnetic field is generated by controlling the magnitude of a current passing through the (electro) magnetic field generating element 101 (MFGE). In general, the element may be a coil of conductive wire with a form designed to generate a given magnetic field profile. In the most simple embodiment, the array of electromagnetic field generating elements 101 can be connected to external current sources or voltage sources using the large area electronics as a simple switch, designed to route the current or voltage from the external sources to one or more of the electromagnetic field generating elements as shown in FIG. 1. External current sources are preferred, as if the source is a voltage source, the current flowing through the electromagnetic field generating element (and hence the magnetic field strength) is defined by the resistance of the electromagnetic field generating element. For this reason, any variations in resistance may result in differences in the magnetic field strength.

Preferably, the magnetic field generation device is realised in large area electronics technology which also is employed for manufacturing active matrix, e.g. TFTs or LCDs) such as low temperature poly silicon (LTPS), amorphous Si, diode, MIM (metal-insulator-metal) etc. Furthermore, the device may be realized in the CMOS-based technology. Preferably, the driving of such an array is realized using e.g. active matrix or CMOS-based driving principles.

For this embodiment, the switches could be realized as transistor switches, diode switches or MIM (metal-insulator-metal) diode switches, and addressing of one or more individual electromagnetic field generating element can be carried out using the well known active matrix driving principles, making use of the line-at-a-time addressing approach as opposed to the random access approach employed in traditional CMOS circuitry.

Figure 2:
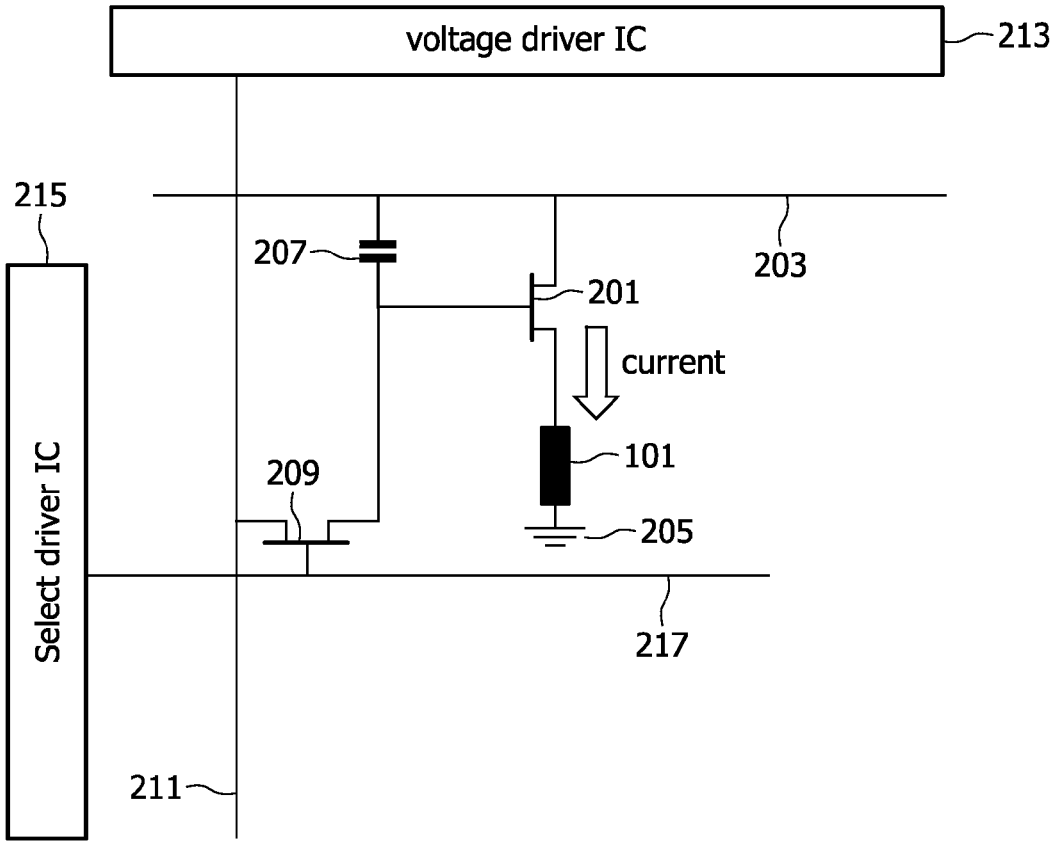
FIG. 2 shows a magnetic field generation device according to another aspect.

FIG. 2 shows a magnetic field generation device according to another aspect. The device comprises a magnetic field generating element 101 connected via a current source transistor 201 to a voltage power line 203. The magnetic field generating element 101 is further connected to a common electrode 205. Furthermore, a memory element 207, e.g. a capacitor, is connected between the voltage power line 203 and a terminal of a transistor switch 209. Another terminal of the transistor switch 209 is connected to a control line 211 being connected to a voltage driver IC 213. A control terminal (e.g. a gate) of the transistor switch 209 is connected to another control line 215 being connected to a select driver IC 215. The select driver IC 215 is further connected to a select line 217 which is connected with a gate of the transistor switch 209.

In FIG. 2, a local driver for the active matrix electromagnetic field generating element system is shown. The driver locally generates a current level for the electromagnetic field generating element 101.

According to the embodiment shown in FIG. 1, the magnetic field is only present when the electromagnetic field generating element is in electrical contact with the external source. In the matrix construction, this means that only a single electromagnetic field generating element per column of the device may be actuated at the same time. This may limit the control over the magnetic field profile, as the field profile is ideally generated by activating more than one electromagnetic field generating element at the same moment.

In order to avoid this limitation, a magnetic field is generated as shown in FIG. 2 by controlling the magnitude of a current passing through the electromagnetic field generating element using an internal current source for each electromagnetic field generating element 101.

As shown in FIG. 2, if a (e.g. low temperature poly-silicon, LTPS) transistor were to be used as a localized current source in an active matrix array which is suitable for an array of resistive magnetic field generating elements, the most simple form of current source is the trans-conductance circuit with e.g. two transistors. In this case, the output of each current source is defined by $$\text{Current}=\text{constant}\times\text{mobility}\times(V\text{power}-V\text{magnetic field}-V\text{threshold})^2$$

Where Vpower is the power line voltage, Vmagnetic field the programmed voltage to define the local magnetic field and the constant is defined by the dimensions of the transistor. The mobility is a material constant. According to the invention, the mobility is preferably in the range $\geqq 0.01$ to $\leqq 500$ or $\geqq 0.1$ to $\leqq 100$ or $\geqq 0.3$ to $\leqq 3$.

Such an internal current source can be used by a single electromagnetic field generating element 101 to create a localized magnetic field, whilst to activate elements in more than one line 101 at a time a memory element 207 is required in the current source circuit in order to maintain the magnetic field in a period whereby electromagnetic field generating elements 101 in subsequent lines are being activated. Such a memory element is conveniently realized in the form of a capacitor, as also shown in FIG. 2. In this manner, any number of the electromagnetic field generating elements in the array can be operated simultaneously at any reasonable field level, whereby extremely flexible magnetic field profiles can be realized.

The switches 209 and local current sources 201 may be realized as a transistor, and addressing of one or more individual electromagnetic field generating element 101 can be carried out using the well known active matrix driving principles familiar to LCD devices.

One problem however of such a large area electronics based magnetic field generating array is that large area electronics suffers from well known non-uniformity in the performance of the active elements across the substrate. In the case of the preferred LTPS technology, it is known that both the mobility and the threshold voltage (Vthreshold) of transistors varies randomly from device to device (also for devices situated close to each other) and may tend to drift with time.

As an example, as shown in FIG. 2, if e.g. an LTPS transistor were to be used as a localized current source based upon the trans-conductance circuit with 2 transistors, the output of each current source is defined by $$\text{Current}=\text{constant}\times\text{mobility}\times(V\text{power}-V\text{magnetic field}-V\text{threshold})^2$$

For this reason, any random variations of mobility or threshold will directly result in unwanted variations in the current provided and therefore to incorrect magnetic field values. This is a particular problem, as incorrect magnetic fields can result in the wrong magnetic field profiles and hence incorrect functioning of the magnetic MEMS based fluid actuator.

In order to improve the performance of a large area electronics based programmable magnetic field generating array, the inhomogenity and/or inaccuracy of the electronic switches across the array may be compensated for. This can be achieved by creating an array of local current sources whereby the variation of the output of the current source is substantially reduced compared to that found in the trans-conductance current source described above (see FIG. 2).

Specifically, local current sources may be provided where either transistor variations in the mobility, the threshold voltage, or both are (partially) compensated. This results in a higher uniformity in the programmed current across the array.

The magnetic field generating array can be used to either maintain a more constant magnetic field across portions of the entire device, or alternatively to create a defined magnetic field profile providing that the device is also configured in the preferred form of an array. In this manner, the device can operate optimally at the required magnetic field profiles.

In all cases, the magnetic field generating array preferably comprises a multiplicity of individually addressable and drivable magnetic field generating elements. It may however optionally comprise additional elements such as heating elements, non-magnetic sensing elements etc.

Figure 3:
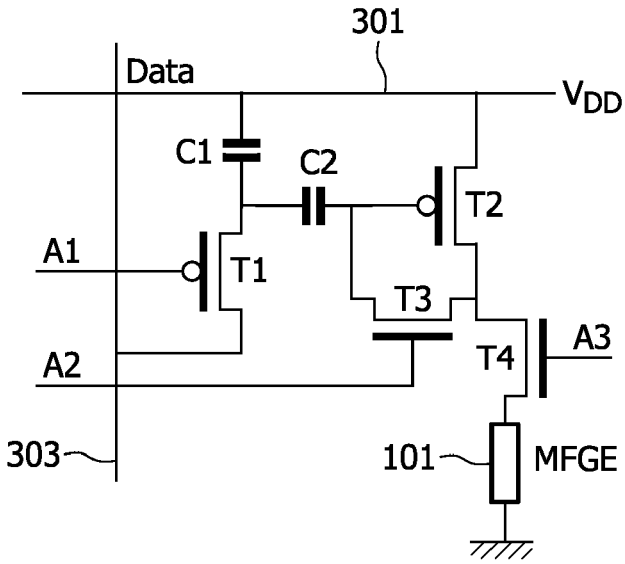
FIG. 3 shows a diagram of a local current source according to an aspect.

FIG. 3 shows a diagram of a local current source comprising a magnetic field generating element 101 coupled via transistors T4 and T2 to a voltage line 301 at e.g. a potential VDD. The transistors T2 and T4 are connected in series, wherein a terminal of the transistor T4 is connected via a transistor T3 to the gate of the transistor T2. This terminal is connected via capacitors C2 and C1 to the voltage line 301. The gate of the transistor T2 is connected via the capacitor C2 and via a transistor T1 to a data line 303. A signal A1 may be applied to the gate of the transistor T1, a signal A2 may be applied to a gate of the transistor T3 and a signal A3 may be applied to the gate of the transistor T4.

According to the embodiment shown in FIG. 3, a threshold voltage compensating circuit is incorporated into a localized current source for application in a programmable magnetic field generating array. A wide variety of circuits for compensating for threshold voltage variations are available (e.g. R. M. A. Dawson and M. G. Kane, 'Pursuit of Active Matrix Light Emitting Diode Displays', 2001 SID conference proceeding 24.1, p. 372) and will be incorporated within this invention; for clarity this embodiment of the invention will be illustrated using the local current source circuit shown in FIG. 3.

The circuit shown in FIG. 3 operates by holding a reference voltage e.g. VDD on the data line with T1 and T3 turned on, T4 is then briefly turned on and this causes T2 to turn on. After the pulse T2 charges C2 to the threshold of T2. Then T3 is turned off storing the threshold on C2. Then the data voltage is applied and C1 is charged to this voltage. Therefore the gate-source voltage of T2 is the data voltage plus its threshold. Therefore the current (which is proportional to the gate-source voltage minus the threshold voltage squared) becomes independent of the threshold voltage of T2. Therefore a uniform current can be applied to an array of magnetic field generating elements. An advantage of this class of circuit is that the programming of the local current source can still be carried out with a voltage signal, as is standard in active matrix display applications.

In order to further reduce the variations in the mobility of the transistors, a mobility and threshold voltage compensating circuit may be incorporated into a localized current source for application in a programmable magnetic field generating array. A wide variety of circuits for compensating for both mobility and threshold voltage variations are available (e.g. A. Yumoto et al, 'Pixel-Driving Methods for Large-Sized Poly-Si AmOLED Displays', Asia Display IDW01, p. 1305) and will be incorporated within this invention. For clarity reasons, this embodiment is illustrated using the local current source circuit shown in FIG. 4.

Figure 4:
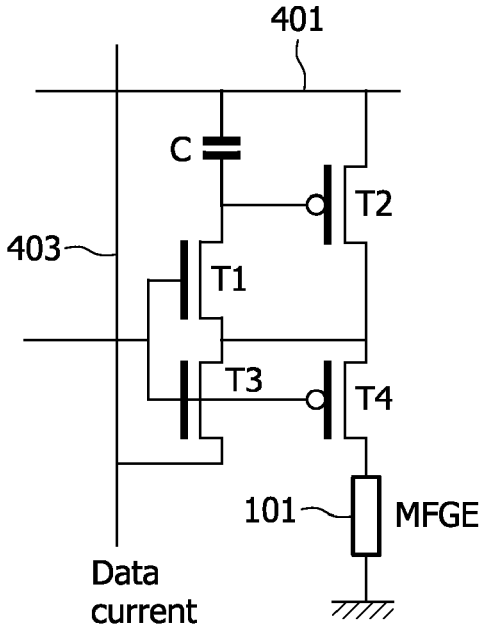
FIG. 4 shows a diagram of a local current source according to another aspect.

Referring to FIG. 4, a MFGE 101 is connected via serially connected transistors T4 and T2 to a voltage line 401. A gate of the transistor T2 is connected via a capacitor C to the line 401. This gate is further connected via serially connected transistors T1 and T3 to a data current line 403. The gates of the transistors T1 and T3 are connected to a gate of the transistor T4.

The circuit shown in FIG. 4 is programmed with a current when T1 and T3 are on and T4 is off. This charges C to a voltage sufficient to pass the programmed current through T2. Then T1 and T3 are turned off to store the charge on C and T4 is turned on to pass current to the magnetic field generating element. A compensation of both threshold and mobility variations of T2 is achieved so uniform currents can be delivered to an array of magnetic field generating elements. An advantage of this class of circuit is that variations in the mobility of the e.g. TFT will also be compensated by the circuit.

One issue with the approaches taken in the above embodiments is that the magnetic field profile may be defined by the data signals. Any unexpected variation in the characteristics of the device may therefore result in an incorrect magnetic field profile. For this reason, in the embodiment shown in FIG. 5, an active magnetic field control of magnetic field generating elements in an active matrix array is provided, making use of magnetic field sensors and any of the well known feedback schemes.

Figure 5:
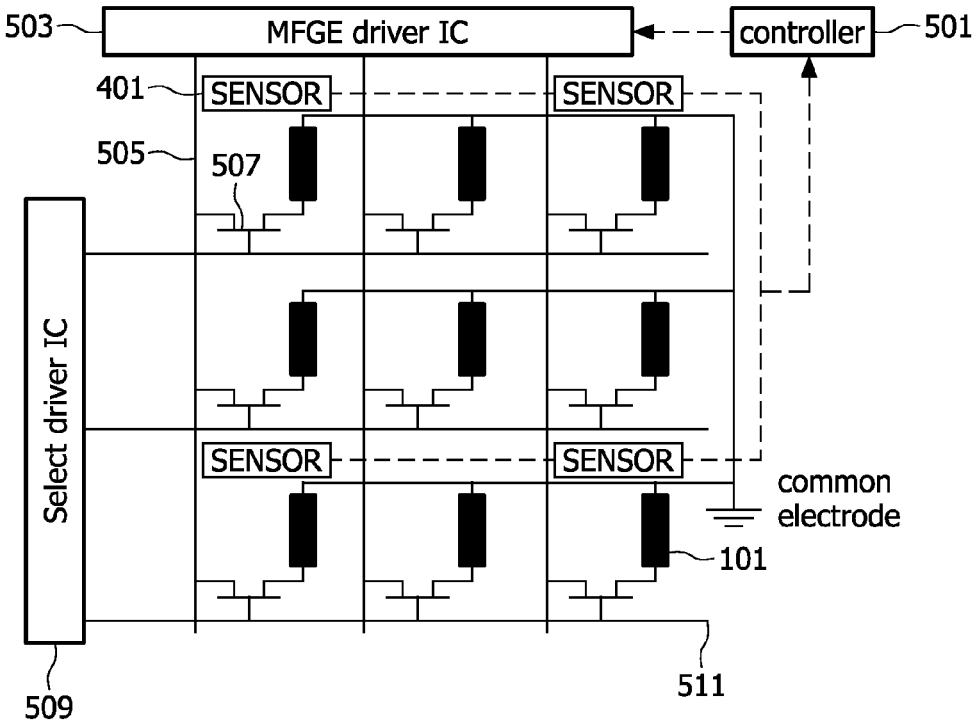
FIG. 5 shows a magnetic field generation device according to another aspect.

FIG. 5 shows a plurality of magnetic field generating elements 101 being arranged to form a matrix and a plurality of magnetic field sensors 401, wherein each sensor 401 is assigned to a corresponding magnetic field generating element 101. A controller 501 is provided which is coupled with the magnetic field sensors 401 and with a MFGE driver IC 503 which is connected via lines 505 and switch transistors 507 to each magnetic field generating element 101. Furthermore, a select driver IC 509 is provided which is connected via lines 511 to gates of the switch transistors 507.

The magnetic field sensors 401 may be any of the known magnetic field sensors (such as Hall-effect sensors, (giant) magneto-resistance sensors etc). The feedback of the sensor function to the magnetic field generating elements may be done either externally to the array (using an external controller), or even locally if the sensor is combined with the array. In a preferred embodiment, the sensor could even be realized in a technology based upon the technology used to realize the magnetic field generating element array (such as LTPS). In further embodiments, a sensor could be associated with every magnetic field generating element, with a plurality of magnetic field generating elements or alternatively a multiplicity of sensors could be associated with a single magnetic field generating element. This approach provides a high degree of certainty that programmed magnetic fields are actually realized (which may assist in obtaining approval to use such devices).

Figure 6:
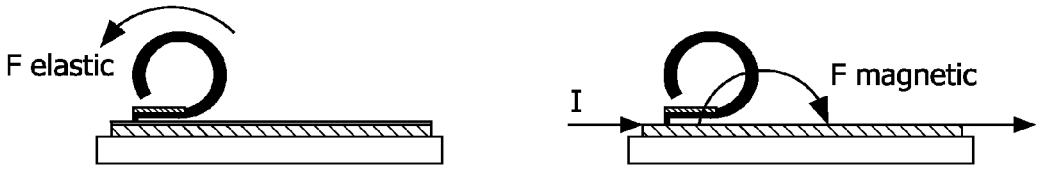
FIG. 6 shows a micro-fluidic actuator.

FIG. 6 shows a schematic cross-section of a rollable magnetic polymer MEMS actuated with a magnetic field. Upper left: non-actuated curled state; upper right: actuation by a magnetic force generated by a current I through an integrated current wire. Typical sizes of the actuators are between 10 and 500 micron.

In order to help concentrate the magnetic flux from the magnetic field generator, and so increase the efficiency of actuation, it is possible to deposit flux concentrators made from soft magnetic materials. Any soft magnetic material with a high permeability may be used for such flux concentrators. Examples of such materials are, NiFe alloys (e.g. permalloy), CoFe, and nano-Fe materials (e.g. FeN).

The actuation of the polymer micro-actuators in a (biological) fluid will induce fluid flow, i.e. fluid manipulation. To achieve efficient fluid manipulation (transportation, mixing, routing, or other), it is essential that the micro-actuators, or groups of them, can be addressed individually. This would enable the creation of complex fluid flow patterns. The (groups of) actuators could then be actuated slightly out of phase, creating e.g. a wave-like motion of the collective actuators which would result in a transporting flow. The out-of-phase actuation of groups of actuators (or preferably a 90° phase difference) will result in chaotic mixing patterns, if done with proper timing. Other, specific flow patterns can be achieved as well by controlled local addressing of the actuators.

The local magnetic fields at the positions of individual (groups of) polymer micro-actuators, i.e. the magnetic field generating elements (MFGE) are generated by the inventive magnetic field generating devices which may be individually addressable.

Large area electronics, and specifically active matrix technology using for example Thin Film Transistors (TFT), is commonly used in the field of flat panel displays for the drive of many display effects e.g. LCD, OLED and electrophoretic effects.

The operating voltages for the circuits shown in FIGS. 1 to 5 are between 0 and 5V, wherein VDD may be equal to 5 or to 10V.

The invention claimed is:

1. A magnetic field generation device, comprising:

a magnetic field generating element;

a limiter for limiting magnitude of a current through the magnetic field generating element;

a magnetic field sensor configured to sense magnitude of a magnetic field generated by the magnetic field generating element; and a current circuit for generating the current through the magnetic field generating element, the current circuit comprising a transistor and a threshold voltage compensation circuit for compensating threshold voltage variations of the transistor.

2. The magnetic field generation device according to claim 1, wherein the magnetic field generating element comprises a wire.

3. The magnetic field generation device according to claim 1, further comprising a controller for controlling the limiter in response to a measurement signal provided by the magnetic field sensor.

4. The magnetic field generation device according to claim 1, comprising an array of magnetic field generating elements.

5. A micro-fluidic device, comprising:

a plurality of magnetic field generation devices configured to generate a corresonding plurality of magnetic fields; and a plurality of magnetic field sensors, each magnetic field sensor being configured to sense a magnitude of at least one of the plurality of magnetic fields, wherein each magnetic field generation device comprises:

a magnetic field generating element; and a limiter for limiting the magnitude of a current through the magnetic field generating element.

6. The micro-fluidic device according to claim 5, wherein each limiter comprises a switch for switching on or off a current through the corresponding magnetic field generating element or a voltage across the corresponding magnetic field generating element for limiting the magnitude of the current.

7. The micro-fluidic device according to claim 5, wherein each magnetic field generation device further comprises a current source for generating the current through the magnetic field generating element.

8. The micro-fluidic device according to claim 5, wherein each magnetic field generation device further comprises a memory element.

9. The micro-fluidic device as claimed in claim 5, further comprising a micro-actuator actuated by at least one of the plurality of magnetic fields.

10. The micro-fluidic device as claimed in claim 9, wherein the micro-actuator comprises a rollable magnetic polymer micro-electromechanical system (MEMS) device.

11. A magnetic field generation device, comprising:

a plurality of magnetic field generating elements arranged in a matrix, the plurality of magnetic field generating elements being configured to generate a corresponding plurality of magnetic fields;

a plurality of limiters corresponding to the plurality of magnetic field generating elements, the plurality of limiters being configured to limit current through the corresponding plurality of magnetic field generating elements, respectively;

at least one magnetic field sensor configured to sense magnitudes of the magnetic fields generated by the corresponding plurality of magnetic field generating elements; and a controller configured to control the plurality of limiters in response to at least one measurement signal provided by the at least one magnetic field sensor to achieve a predetermined magnetic field profile.

12. The magnetic field generation device according to claim 11, wherein the plurality of magnetic field generating elements are connected to a common electrode.

13. The magnetic field generation device according to claim 11, wherein each limiter of the plurality of limiters comprises a transistor connected between a driver and the corresponding magnetic field generating elements.

14. The magnetic field generation device according to claim 13, wherein each of the transistors is gated to a select driver for turning the transistor on and off.

* * * * *